US008528756B2

(12) United States Patent
Itzek et al.

(10) Patent No.: US 8,528,756 B2
(45) Date of Patent: Sep. 10, 2013

(54) LEAKPROOF CLOSURE SEALING SYSTEM FOR BABY BOTTLE

(75) Inventors: Eckhard Itzek, Gyhum-Nartum (DE); Björn-Frederik Seidler, Scheeβel (DE)

(73) Assignee: MAPA GmbH, Zeven (DE)

( * ) Notice: Subject to any disclaimer, the term of this patent is extended or adjusted under 35 U.S.C. 154(b) by 0 days.

(21) Appl. No.: 13/387,650

(22) PCT Filed: Jul. 30, 2010

(86) PCT No.: PCT/EP2010/004669

§ 371 (c)(1),
(2), (4) Date: Mar. 14, 2012

(87) PCT Pub. No.: WO2011/012310

PCT Pub. Date: Feb. 3, 2011

(65) Prior Publication Data

US 2012/0175335 A1 Jul. 12, 2012

(30) Foreign Application Priority Data

Jul. 31, 2009 (DE) ..... 10 2009 035 598

(51) Int. Cl.
*A61J 9/08* (2006.01)
*B65D 45/30* (2006.01)

(52) U.S. Cl.
USPC ..... 215/11.4; 215/11.6; 215/276; 215/277

(58) Field of Classification Search
USPC ..... 215/11.1–11.6, 274, 276, 277
See application file for complete search history.

(56) References Cited

U.S. PATENT DOCUMENTS

| | | | | |
|---|---|---|---|---|
| 3,211,315 | A | 10/1965 | Griesinger | |
| 3,777,753 | A * | 12/1973 | Kesselring et al. | 215/11.1 |
| 4,505,398 | A * | 3/1985 | Kesselring | 215/11.5 |
| 4,526,274 | A * | 7/1985 | Kesselring et al. | 206/231 |
| 4,856,995 | A * | 8/1989 | Wagner | 433/215 |
| 5,993,479 | A | 11/1999 | Prentiss | |
| 6,357,620 | B1 * | 3/2002 | Hakim | 220/714 |
| 6,971,551 | B2 * | 12/2005 | Widgery | 222/129 |
| 7,225,938 | B2 * | 6/2007 | Frisch | 215/11.4 |

(Continued)

FOREIGN PATENT DOCUMENTS

| | | | |
|---|---|---|---|
| DE | 3317849 | A1 * | 11/1984 |
| DE | 3337248 | A1 * | 11/1984 |

(Continued)

*Primary Examiner* — J. Gregory Pickett
*Assistant Examiner* — Ned A Walker
(74) *Attorney, Agent, or Firm* — Vidas, Arrett & Steinkraus, P.A.

(57) ABSTRACT

A closure system for a baby bottle including a lower closure ring screwed onto an external thread of a bottle, an upper closure ring for connecting to a screw ring for fastening a drinking teat, locking elements which rotatably and releasably lock together the lower closure ring and the upper closure ring, a circular lip seal made of a soft elastic material concentric to a lower peripheral part being arranged on the first upper face, with at least one axially oriented sealing lip and at least one circular seal geometry engaging with the lip seal and concentric to an upper peripheral part being arranged on a second lower face or vice versa and by rotating the upper closure ring relative to the lower closure ring the upper throughflow hole may optionally be brought into overlapping and non-overlapping positions relative to a lower throughflow hole.

11 Claims, 9 Drawing Sheets

(56) References Cited

U.S. PATENT DOCUMENTS

| | | | | |
|---|---|---|---|---|
| 7,331,478 | B2 * | 2/2008 | Aljadi | 215/11.4 |
| 7,677,402 | B2 * | 3/2010 | Mensah-Ouvor et al. | 215/11.4 |
| 7,938,281 | B2 * | 5/2011 | Horntrich et al. | 215/11.6 |
| 2003/0168474 | A1 | 9/2003 | Widgery | |
| 2009/0039049 | A1 * | 2/2009 | Horntrich et al. | 215/11.6 |
| 2009/0178940 | A1 | 7/2009 | Said | |
| 2011/0042339 | A1 * | 2/2011 | Pfenniger et al. | 215/11.5 |
| 2011/0198309 | A1 * | 8/2011 | Itzek et al. | 215/11.1 |
| 2011/0266246 | A1 * | 11/2011 | Itzek | 215/11.6 |
| 2013/0056435 | A1 * | 3/2013 | Itzek | 215/11.5 |

FOREIGN PATENT DOCUMENTS

| | | | |
|---|---|---|---|
| DE | 29621392 | U1 * | 2/1997 |
| DE | 10157071 | C1 * | 3/2003 |
| GB | 1335381 | A | 10/1973 |
| WO | 2007/042117 | A1 | 4/2007 |

* cited by examiner

LEAKPROOF CLOSURE SEALING SYSTEM FOR BABY BOTTLE

CROSS-REFERENCE TO RELATED APPLICATIONS

Not applicable.

STATEMENT REGARDING FEDERALLY SPONSORED RESEARCH

Not applicable.

BACKGROUND OF THE INVENTION

The invention relates to a closure system for a leakproof baby feeding bottle.

In known baby feeding bottles, the teat at the lower edge has a peripheral teat flange which is secured sealingly to the edge of a bottle opening by means of a screw ring screwed onto an external thread of the bottle. In order to prevent leakage of liquid during breaks from drinking, a lid is placed between the teat flange and the flange edge and secured by means of the screw ring.

A more user-friendly leakproof baby feeding bottle is disclosed in DE 101 57 071 C1. Said bottle has a lower closure ring which is screwed onto the external thread of the bottle and which has a first seat surface with at least one first throughflow hole.

An upper closure ring has a second seat surface with at least one second throughflow hole. The two closure rings are able to be rotated relative to one another and releasably locked together via locking elements. By rotating the upper closure ring, the first and second throughflow holes are able to be brought into overlapping and non-overlapping positions. A drinking teat is screwed by means of a screw ring to an external thread of the upper closure ring. If the throughflow holes overlap one another, baby food is able to be taken through the drinking teat. If the throughflow holes do not overlap one another, the removal of baby food through the drinking teat is blocked.

In the exemplary embodiment, the closure rings comprise conical seat surfaces. Moreover, sealing rings are present on the lower face of the lower closure ring and on the upper face of the first seat surface. The lower closure ring comprises a locking projection protruding inwardly from the lower conical seat surface and the upper closure ring has snap tongues protruding from the lower second conical seat surface and which engage behind the locking projection.

The manufacture and usage of the leakproof bottle is, to a certain extent, still complicated. Due to the complex spatial shape, dirt is able to collect on the closure rings. The snap tongues come into contact with the baby food and have to be handled for dismantling. The cleaning of the closure rings is complicated.

WO 2007/042117 A1 discloses a leakproof baby feeding bottle which simplifies the manufacture and usage. One variant comprises a closure system with a lower closure ring, which has a substantially cylindrical first peripheral part with a first internal thread which is screwed onto an external thread of a bottle, and which comprises a first central part connected to the upper edge of the first peripheral part, with a first seat surface rotationally symmetrical about a longitudinal axis and facing away from the bottle interior, at least one first throughflow hole which opens, on the one hand, in the first seat surface and, on the other hand, in one side of the first central part facing the bottle interior and a soft elastic sealing material made of plastics material, injection-moulded onto the first seat surface at least around the edge of the throughflow hole and onto a sealing surface of the first central part sealingly positioned on the upper bottle edge and which extends from the first seat surface through the first throughflow hole along the side facing the bottle interior as far as the sealing surface of the first central part. Moreover, the closure system comprises an upper closure ring which has a substantially cylindrical second peripheral part with a second external thread, on which a drinking teat of a screw ring with an internal thread is fixed and which comprises a second central part connected to the second peripheral part, with a second seat surface rotationally symmetrical about the longitudinal axis and sealingly located on the first seat surface, and at least one second throughflow hole which opens, on the one hand, in the second seat surface and, on the other hand, in one side of the second central part remote therefrom, and which by rotating the upper closure ring relative to the lower closure ring may be brought into overlapping and non-overlapping positions relative to the first throughflow hole. Moreover, locking elements are present which rotatably and releasably connect together the lower closure ring and the upper closure ring relative to one another.

According to the exemplary embodiment, the soft elastic sealing material is injection-moulded on the lower closure ring and covers a circular portion surrounding the throughflow holes on the first seat surface. Moreover, on the inner periphery of the throughflow holes in each case the sealing material has a strip-shaped portion. On the lower face of the first central part, coming from the strip-shaped portions, further strip-shaped portions of the soft elastic sealing material are present, which extend down the inner face of a cylindrical portion of the first peripheral part and are connected at the bottom to an annular peripheral sealing surface made of the same material, which is arranged on the inner face of a step of the first peripheral part. The sealing material is, for example, a thermoplastic elastomer.

In the known closure system, the seal is created between the lower closure ring and the upper closure ring between the circular disc-shaped soft elastic sealing material of the first seat surface of the lower closure ring and the substantially planar second seat surface of the upper closure ring, located thereon. Here, it may lead to leakages, in particular when the seat surfaces do not bear exactly against one another with a specific contact pressure. Moreover, the friction between the first seat surface made of soft elastic sealing material and the second seat surface, may hinder the rotation of the upper closure ring relative to the lower closure ring.

Against this background, the object of the invention is to provide a closure system for a leakproof baby feeding bottle with improved usage properties.

BRIEF SUMMARY OF THE INVENTION

The closure system according to the invention for a leakproof baby feeding bottle comprises

- a lower closure ring which has a substantially cylindrical lower peripheral part with an internal thread, which may be screwed onto an external thread of a bottle and comprises a lower partition connected to the lower peripheral part on the edge above the internal thread and blocking its cross section, with a first upper face and a first lower face, and at least one lower throughflow hole which opens, on the one hand, in the first upper face and, on the other hand, in the first lower face,
- an upper closure ring which comprises a substantially cylindrical upper peripheral part with an external thread for connecting to a screw ring for fastening a drinking teat to the upper peripheral part and an upper partition connected to the upper peripheral part on the edge and blocking its cross section, with a second upper face and a second lower face located sealingly on the first upper face and at least one upper throughflow hole which opens, on the one hand, in the second lower face and, on the other hand, in the second upper face, locking elements which rotatably and releasably lock together the lower closure ring and the upper closure ring relative to one another, a circular lip seal made of a soft elastic material concentric to the lower peripheral part being arranged on the first upper face, with at least one axially oriented sealing lip and at least one circular seal geometry engaging with the lip seal and concentric to the upper peripheral part being arranged on the second lower face or vice versa and by rotating the upper closure ring relative to the lower closure ring the upper throughflow hole may be brought into overlapping and non-overlapping positions relative to the lower throughflow hole.

The closure system according to the invention is able to be screwed by the internal thread of the lower closure ring to a leakproof baby feeding bottle. Moreover, a drinking teat is able to be screwed onto the external thread of the upper closure ring by means of a screw ring. In this case, the lower closure ring may be located sealingly on the upper edge of the bottle and the drinking teat may be located sealingly on the upper edge of the upper peripheral part of the upper closure ring.

The closure rings are connected together rotatably and releasably relative to one another via the locking elements. The closure rings have one lower and at least one upper throughflow hole which, by rotating the upper closure ring relative to the lower closure ring, may be brought into overlapping and non-overlapping positions. If the at least one lower and the at least one upper throughflow hole overlap, baby food is able to be taken. If they do not overlap, the closure system blocks the removal of liquid baby food. The lower closure ring and the upper closure ring bear with the first upper face and the second lower face flat against one another, so that in principle baby food is not able to flow out between the two closure rings to the side.

At least one circular lip seal and at least one circular seal geometry engaging therewith are present as an additional lateral seal of the contact region between the first upper face and the second lower face. In this case, either the lower closure ring has the at least one circular lip seal and the upper closure ring has the at least one circular seal geometry or the lower closure ring has the at least one circular seal geometry and the upper closure ring the at least one circular lip seal. It is also possible that both the upper closure ring and the lower closure ring have at least one circular lip seal and at least one circular seal geometry. The at least one circular lip seal and the at least one circular seal geometry are arranged such that they surround the lower and the upper throughflow holes. They are arranged concentrically to the lower peripheral part and the upper peripheral part, so that they do not hinder the rotation of the upper closure ring relative to the lower closure ring. By the at least one circular lip seal and the at least one circular seal geometry, the seal between the lower and upper closure rings is improved and the escape of liquid baby food to the side is prevented even more effectively. In this case, it is particularly advantageous that the axially oriented sealing lip and a corresponding seal geometry in the axial direction of the cylindrical peripheral parts engage in one another so that the lower closure ring and the upper closure ring may be easily joined together and separated from one another.

The closure system according to the invention for a leakproof baby feeding bottle comprises a lower closure ring which has a substantially cylindrical lower peripheral part with an internal thread, which may be screwed onto an external thread of a bottle and comprises a lower partition connected to the lower peripheral part on the edge above the internal thread and blocking its cross section, with a first upper face and a first lower face and at least one lower throughflow hole which opens, on the one hand, in the first upper face and, on the other hand, in the first lower face, an upper closure ring which comprises a substantially cylindrical upper peripheral part with an external thread for connecting to a screw ring for fastening a drinking teat to the upper peripheral part and an upper partition connected to the upper peripheral part on the edge and blocking its cross section, with a second upper face and a second lower face located sealingly on the first upper face and at least one upper throughflow hole which opens, on the one hand, in the second lower face and, on the other hand, in the second upper face, locking elements which rotatably and releasably lock together the lower closure ring and the upper closure ring relative to one another, at least one cake slice-shaped sealing cushion made of a soft elastic material being arranged on the first upper face of the lower partition and at least one upper throughflow hole with a sealing seat on the edge complementary to the cake-slice shape being arranged in the second lower face of the upper partition or vice versa and optionally the upper throughflow hole being able to be brought by rotating the upper closure ring relative to the lower closure ring into an overlapping position relative to the lower throughflow hole and the sealing seat into the sealed position relative to the sealing cushion.

The closure system according to the invention is able to be screwed by the internal thread of the lower closure ring onto a leakproof baby feeding bottle. Moreover, a drinking teat is able to be screwed by means of a screw ring onto the external thread of the upper closure ring. In this case, the lower closure ring is able to be located sealingly on the upper edge of the bottle and the drinking teat is able to be located sealingly on the upper edge of the upper peripheral part of the upper closure ring.

The closure rings are connected together rotatably and releasably relative to one another via the locking elements. The closure rings have one lower and at least one upper throughflow hole which, by rotating the upper closure ring relative to the lower closure ring, may be brought into overlapping and non-overlapping positions. If the at least one lower and the at least one upper throughflow hole overlap, baby food is able to be removed. If they do not overlap, the closure system blocks the removal of liquid baby food. The lower closure ring and the upper closure ring bear with the first upper face and the second lower face flat against one another so that, in principle, baby food is not able to flow out to the side between the two closure rings.

If the upper closure ring is rotated relative to the lower closure ring such that it is arranged with the one sealing seat in a sealed position relative to the at least one sealing cushion, the throughflow of liquid baby food is prevented through the at least one lower throughflow hole and the at least one upper throughflow hole. At the same time, therefore, it is prevented that liquid baby food escapes to the side through the contact region between the first upper face of the lower partition and the second lower face of the upper partition. The at least one sealing cushion is arranged either on the first upper face of the lower partition and the at least one sealing seat is arranged on the second lower face of the upper partition or the at least one sealing cushion is arranged on the second lower face of the upper partition and the at least one sealing seat is arranged on the first upper face of the lower partition. Moreover, the invention incorporates possible embodiments in which the lower partition comprises at least one cake slice-shaped sealing cushion and at least one cake slice-shaped sealing seat and the upper partition at least one sealing cushion complementary thereto and at least one sealing seat complementary to the at least one cake slice-shaped sealing cushion of the lower partition.

The cake-slice shape of the sealing cushion and the sealing seat complementary thereto promote a particularly advantageous shape of the throughflow holes for the removal of liquid baby food and a particularly sealed seal of said throughflow holes. According to a preferred embodiment, the sealing seat is a peripheral edge about the at least one upper throughflow hole, against which the sealing cushion sealingly bears on the edge, when the sealing seat is brought into the sealed position relative to the sealing cushion. The edge is able to be produced with a particularly dimensionally stable or respectively smooth surface. Preferably, it is a chamfer or respectively bevel on the edge of the throughflow hole, into which the sealing cushion is pressed, said sealing cushion bearing sealingly with its edge against the chamfer or bevel.

According to an embodiment of the invention, the outflow of liquid food to the side between the upper and lower closure part is also reliably prevented, when the lower and upper throughflow holes overlap one another.

According to a preferred embodiment which further improves the seal on the edge, the lip seal is a double lip seal.

According to a further embodiment which improves the removal of liquid food and the seal of the closure rings, the lower closure ring and the upper closure ring in each case comprise two diametrically opposing throughflow holes and/or the lower closure ring comprises two diametrically opposing cake slice-shaped sealing cushions and the upper closure ring comprises two diametrically opposing throughflow holes with a sealing seat on the edge or vice versa.

The locking elements may be designed in different ways. According to a preferred embodiment, they are parts of a bayonet closure. A bayonet closure permits a simple connection of the closure ring and the upper closure ring with one another and also allows the user the easy separation of the lower and upper closure ring.

According to a further embodiment, the lower closure ring above the internal thread comprises a circular peripheral sealing element made of a soft elastic material for sealing to the upper edge of a bottle. As a result, the sealing seat of the closure system on the bottle is assisted. In principle, however, it is also possible to insert a specific sealing ring between the closure system and the bottle.

According to a preferred embodiment, the sealing element is circular disc-shaped.

According to a further embodiment, the lip seal and the sealing element consist of a soft elastic material which extends from the lip seal over the first upper face of the lower partition and through the lower through-holes as far as the sealing element. The sealing elements may then be injection-moulded continuously on the lower closure ring. This is advantageous in terms of production technology.

According to one embodiment, the lower and/or upper closure ring comprising the lip seal and/or the sealing cushion and/or the sealing element is produced in a two-component injection-moulding process from a soft elastic plastics component for the lip seal and/or the sealing cushion and/or the sealing element and also from a hard elastic plastics component. The two-component-injection moulding process may be, in particular, a core retraction process or a transfer process.

According to a further embodiment, the lip seal and/or the sealing cushion and/or the sealing element consist of thermoplastic elastomer. The production from thermoplastic elastomer promotes, in particular, the material connection between the lip seal and/or sealing cushion and/or sealing element with the remaining parts of the lower and/or upper closure ring. Basically, it is also possible to connect the lip seal and/or the sealing cushion and/or the sealing element positively and/or non-positively to the remaining parts of the lower and/or closure ring. This applies both to the embodiments of these seals made of thermoplastic elastomer and to possible embodiments of these seals made of a different sealing material, such as for example rubber or silicone.

According to a preferred embodiment, the first upper face is planar and the second lower face is planar. It is further preferred if the first lower face and the second upper face are planar.

According to a further embodiment, the lower closure ring is screwed onto a baby feeding bottle.

According to a further embodiment a drinking teat is held by means of a screw ring on the upper closure ring.

BRIEF DESCRIPTION OF THE SEVERAL VIEWS OF THE DRAWINGS

The invention is described in more detail hereinafter with reference to the accompanying drawings of an exemplary embodiment. In the drawings.

DETAILED DESCRIPTION OF THE INVENTION

While this invention may be embodied in many different forms, there are described in detail herein a specific preferred embodiment of the invention. This description is an exemplification of the principles of the invention and is not intended to limit the invention to the particular embodiment illustrated.

In the present application, the terms "top" and "bottom" refer to the alignment of the closure system if said closure system is screwed onto a bottle and is screwed to a drinking teat, the bottle being vertically aligned and being positioned with the base on a surface and the drinking teat being arranged above the bottle.

Figure 1:
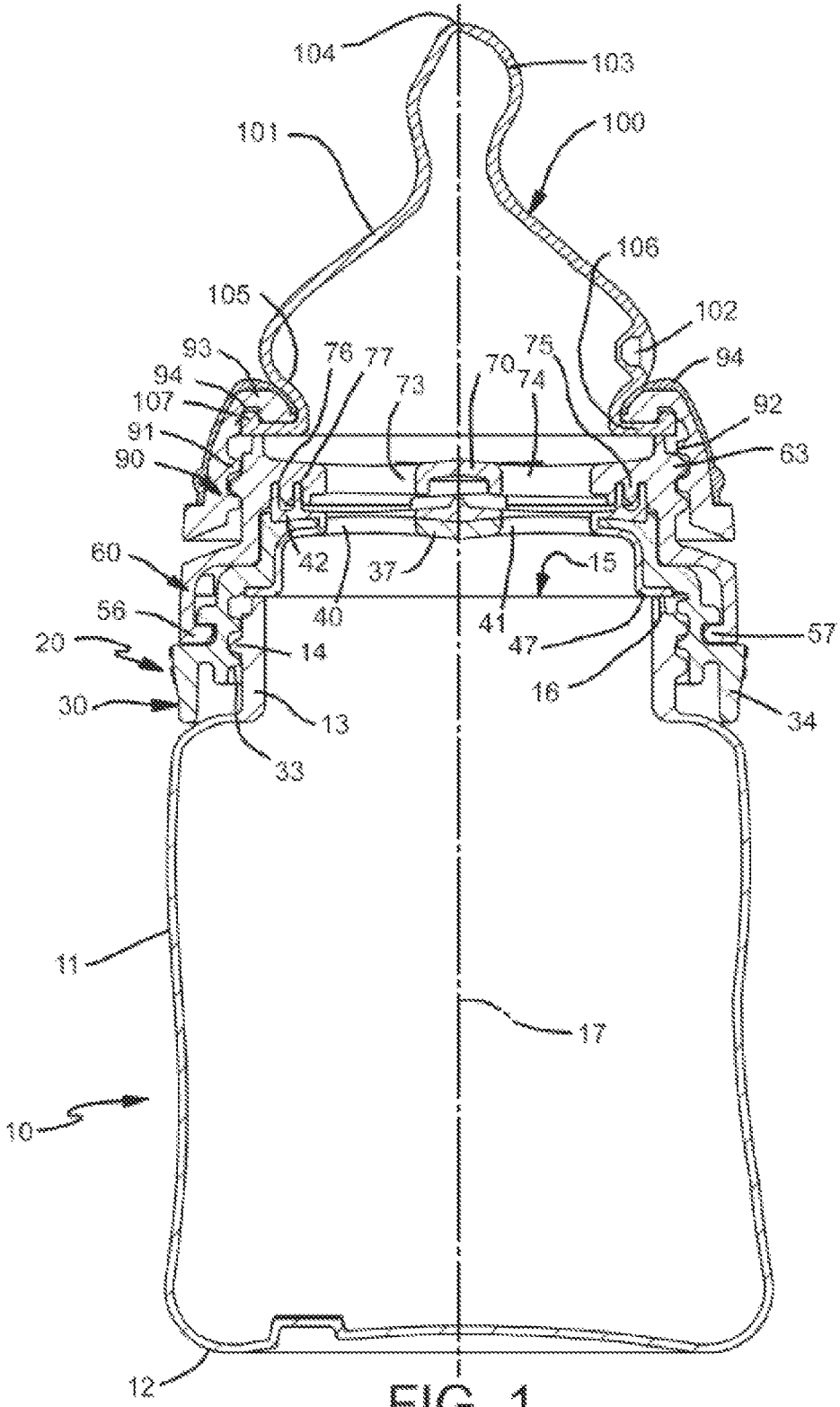
FIG. 1 shows a closure system screwed onto a baby feeding bottle with a screwed-on drinking teat in a vertical section.
Figure 2A:
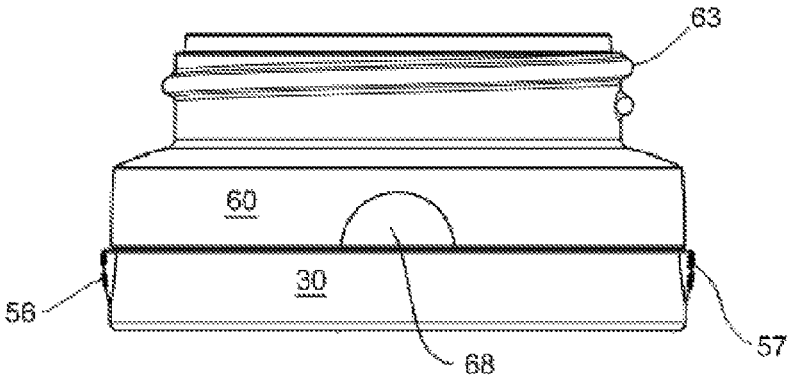
FIGS. 2*a* to *e* show the same closure system in side view (FIG. 2*a*), in a view from the left-hand side (FIG. 2*b*), in a view from the right-hand side (FIG. 2*c*), in a view from below (FIG. 2*d*) and in plan view (FIG. 2*e*)
Figure 2B:
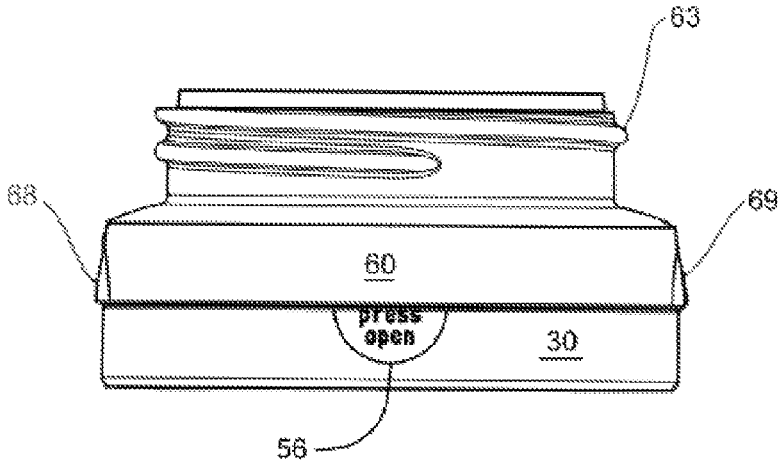
Figure 2C:
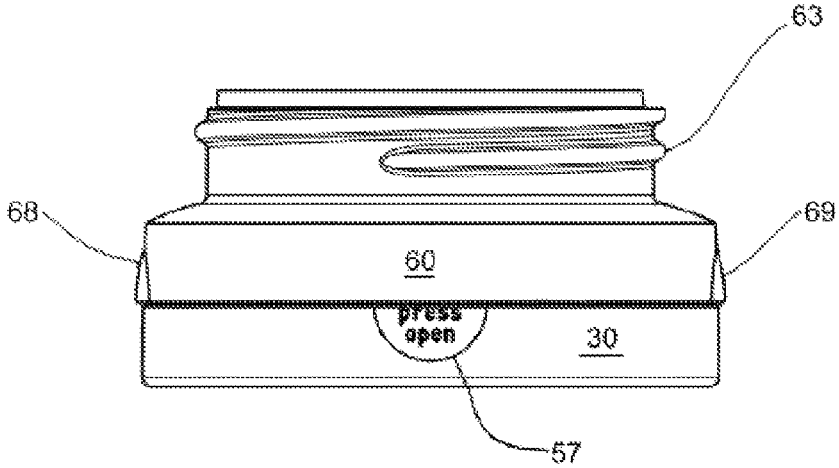
Figure 2D:
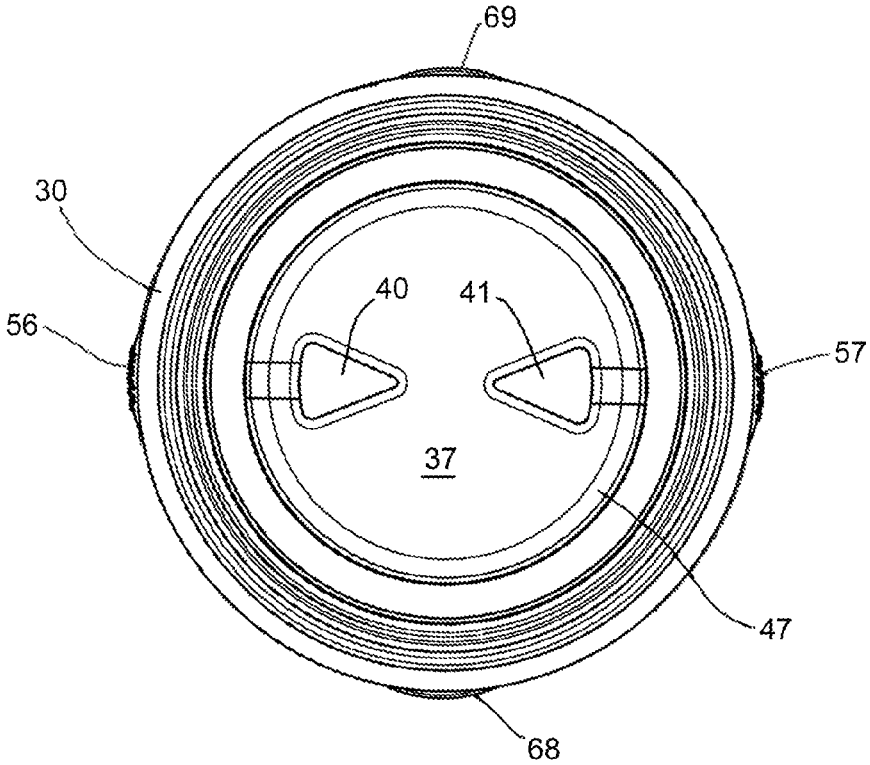
Figure 2E:
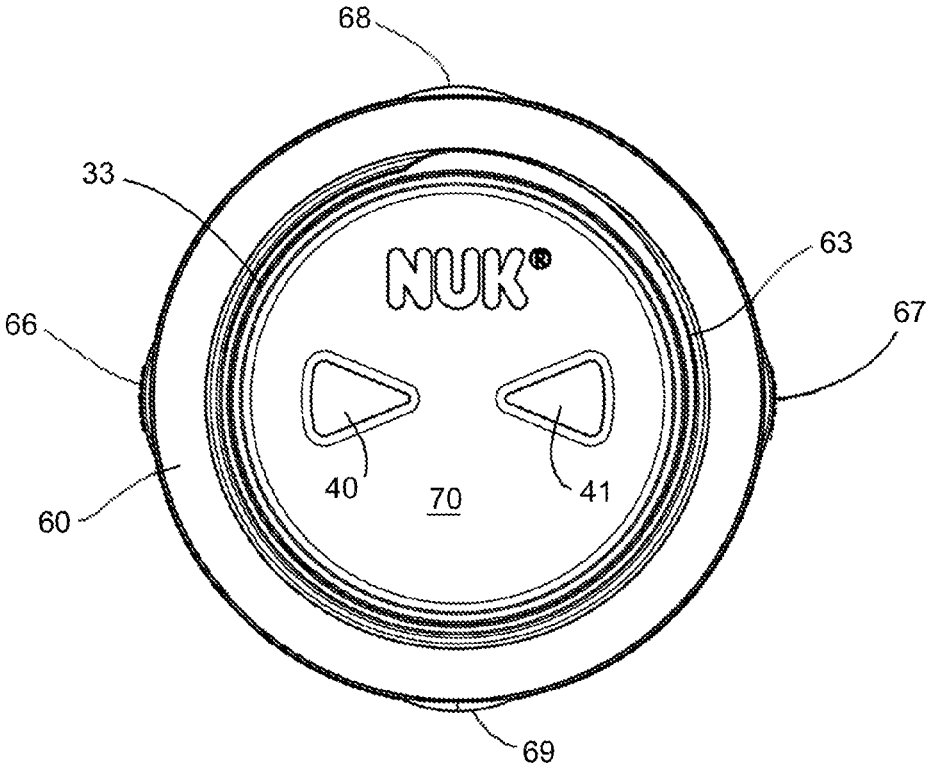
Figure 3A:
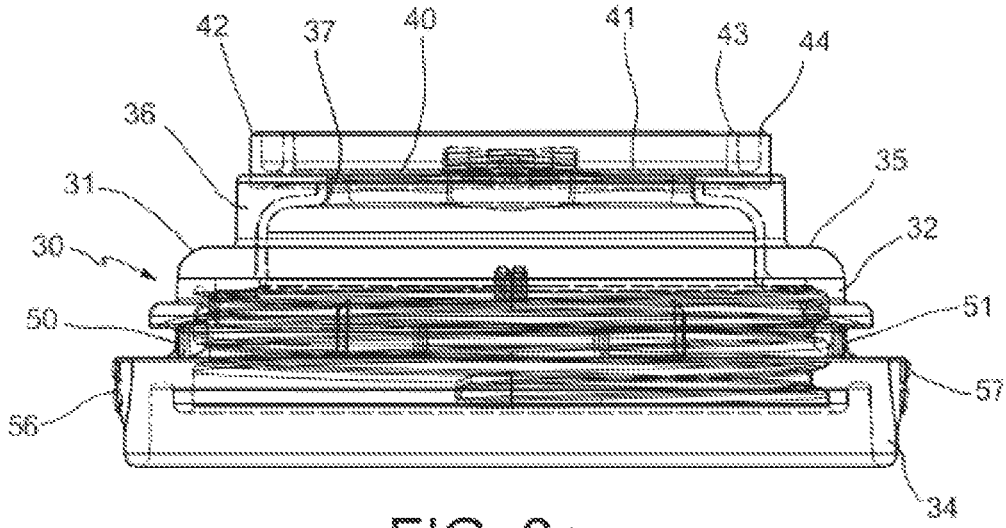
FIGS. 3*a* to *g* show the lower closure ring of the same closure system in front view (FIG. 3*a*), in a view from the right-hand side (FIG. 3*b*), in plan view (FIG. 3*c*), in a view from below (FIG. 3*d*), in a section along the line A-A of FIG. 3*b* (FIG. 3*e*), in a section along the line B-B of FIG. 3*a* (FIG. 3*f*) and in a perspective view obliquely from above and from the side (FIG. 3*g*)
Figure 3B:
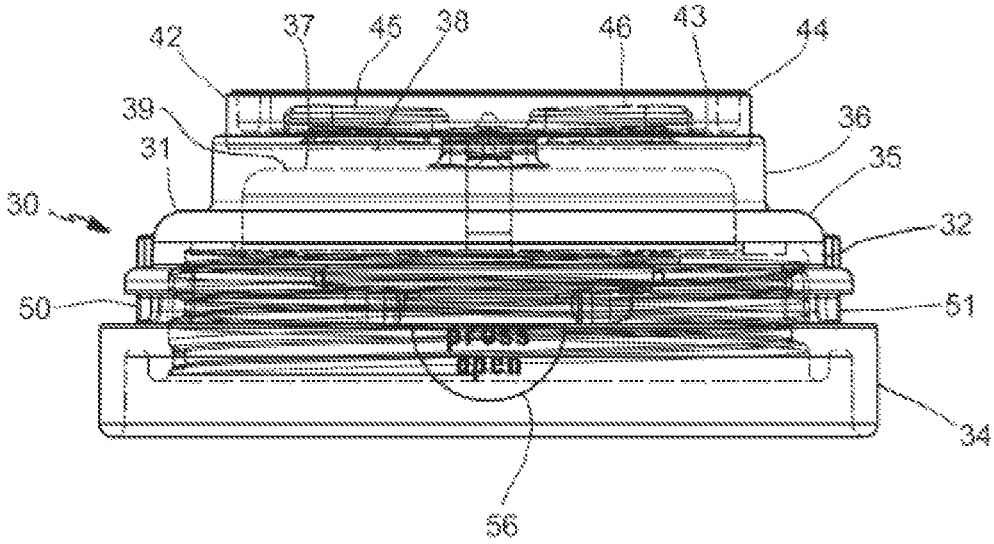
Figure 3C:
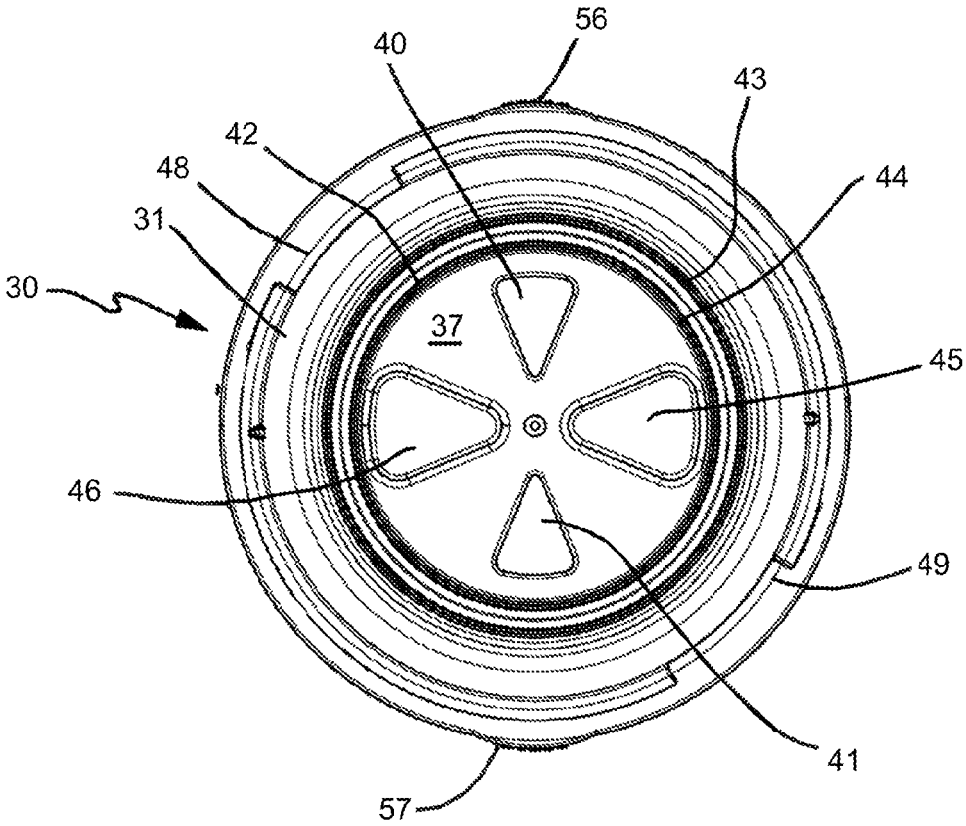
Figure 3D:
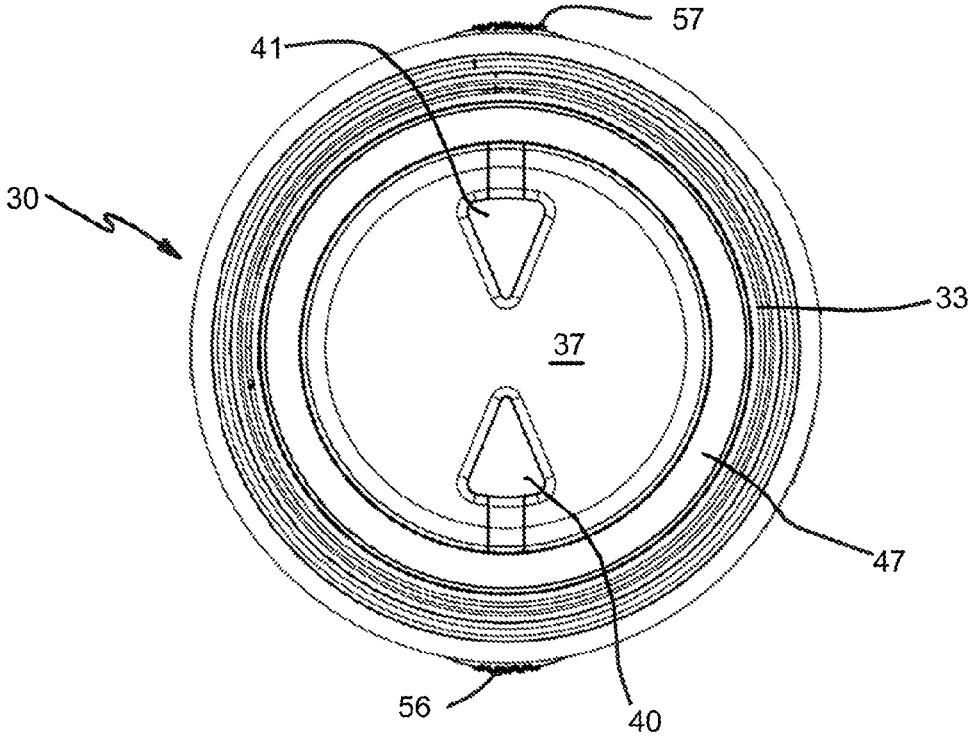
Figure 3E:
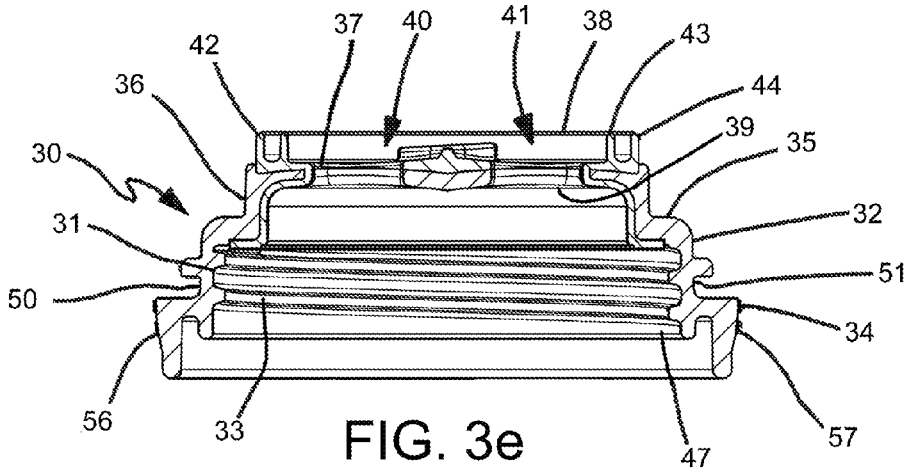
Figure 3F:
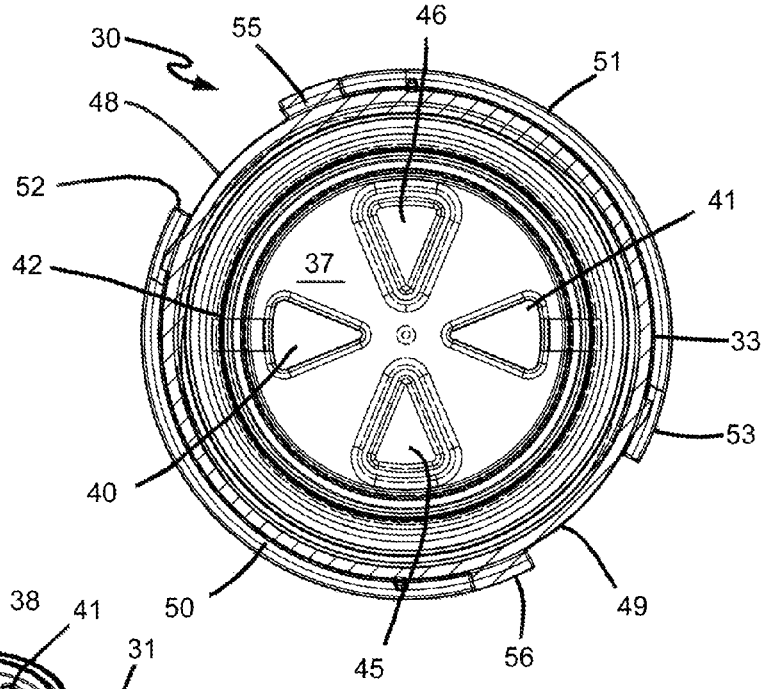
Figure 3G:
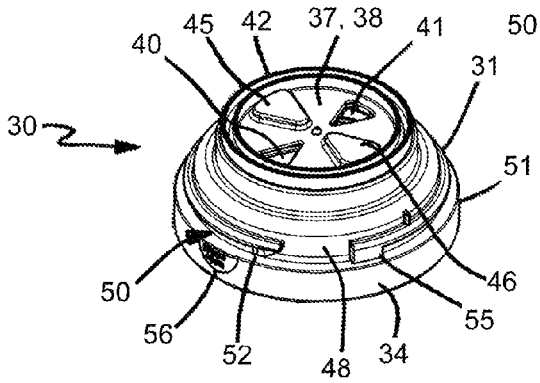
Figure 4A:
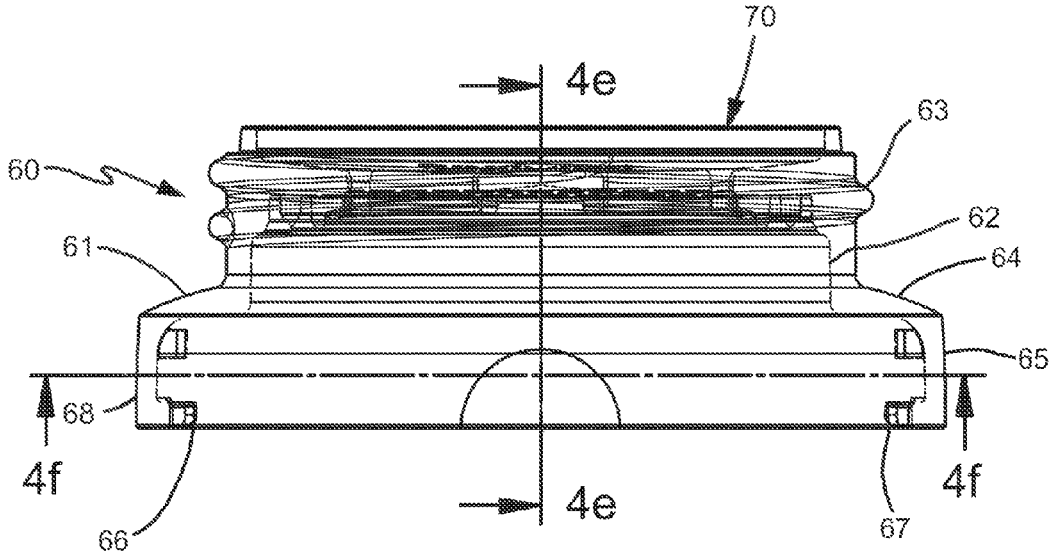
FIGS. 4*a* to *f* show the upper closure ring of the same closure system in front view (FIG. 4*a*), in a view from the right-hand side (FIG. 4*b*), in plan view (FIG. 4*c*), in a view from below (FIG. 4*d*), in a section along the line B-B of FIG. 4*a* (FIG. 4*e*), in a section along the line C-C of FIG. 4*a* (FIG. 4*f*) and in a perspective view obliquely from above and from the side (FIG. 4*g*).
Figure 4B:
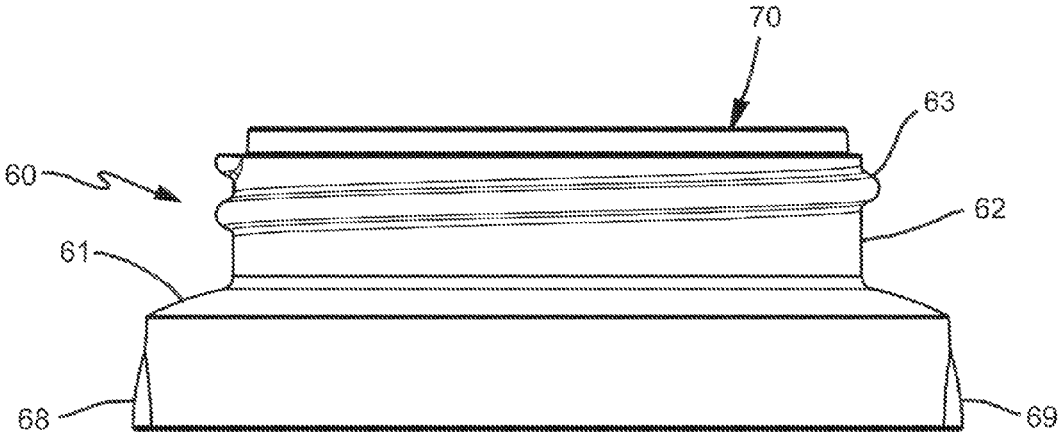
Figure 4C:
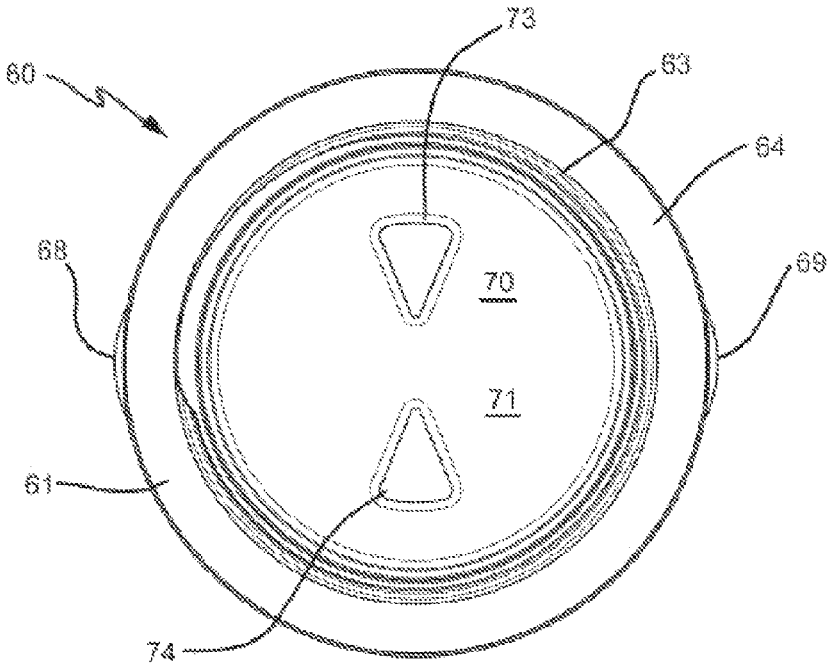
Figure 4D:
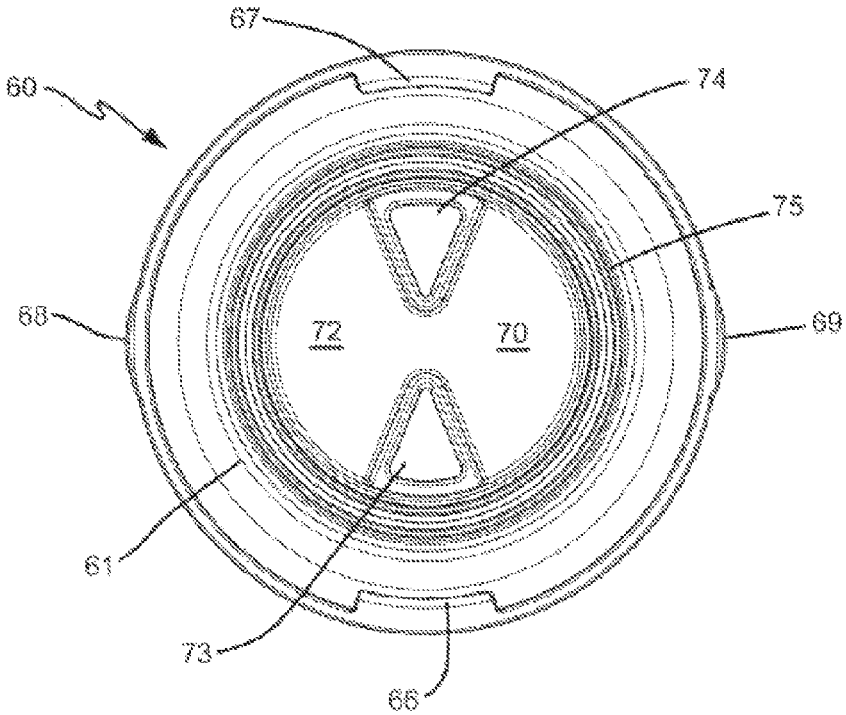
Figure 4E:
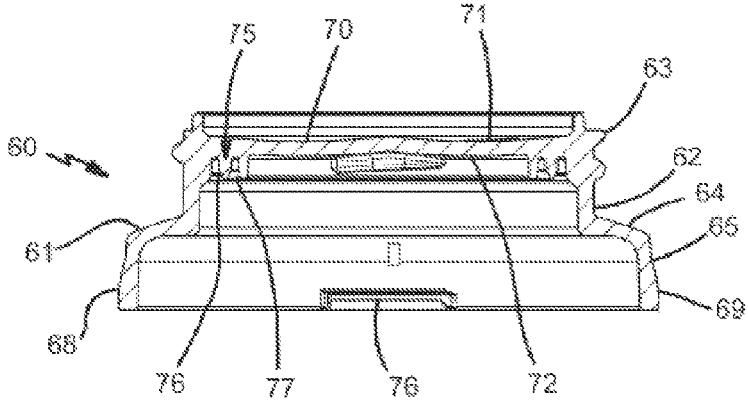
Figure 4F:
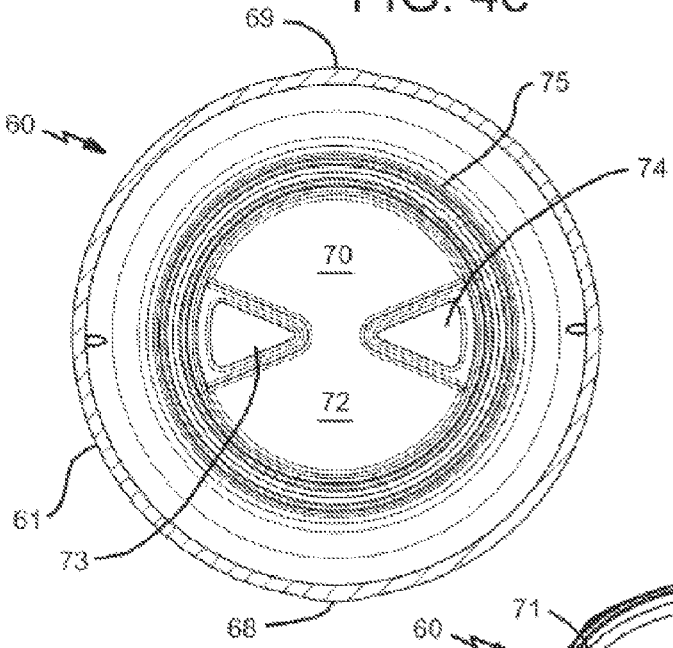
Figure 4G:
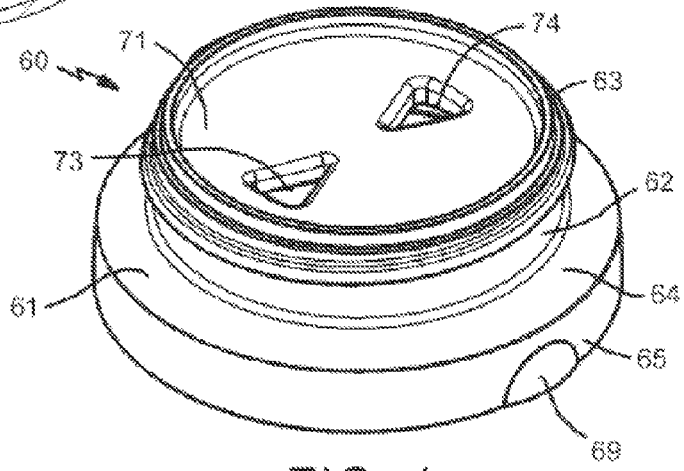

According to FIG. 1 a closure system 20 comprising a lower closure ring 30 and an upper closure ring 60 is screwed onto a baby feeding bottle 10, and a drinking teat 100 is screwed onto the closure system 20 by means of a screw ring 90.

The bottle 10 has a cylindrical, waisted bottle body 11 which comprises a base 12 at the lower end and a neck 13 at the upper end. The neck 13 is designed as a wide neck but has a smaller diameter than the region of the bottle body 11 located therebelow. The neck 13 has a single-flight external bottle thread 14 and at the top has a bottle opening 15. The bottle opening 15 is surrounded by an upper bottle edge 16. The bottle 10 has a longitudinal centre axis 17.

As visible in particular from FIGS. 2 and 3, the lower closure ring 30 has a substantially cylindrical lower peripheral part 31 which comprises a plurality of portions. The first lower peripheral part portion 32 of substantially cylindrical shape has an internal thread 33 on the internal periphery, which according to FIG. 1 is screwed onto the external bottle thread 14. A second lower peripheral part portion 34 protrudes radially outwards and downwards from the periphery of the first lower peripheral part portion 32, and which covers the bottle neck 13 to the side.

Moreover, the lower peripheral part 31 has a third lower peripheral part portion 35 protruding radially inwards from the upper edge of the first lower peripheral part portion 22, which is substantially circular disc-shaped. A substantially cylindrical fourth lower peripheral part portion 36 protrudes axially upwards from the inside of the third lower peripheral part portion 35.

A lower partition 37 is connected to the upper edge of the fourth upper peripheral part portion 36, and which substantially blocks the cross section of the lower closure ring 30.

Said circular disc-shaped partition 37 has a substantially planar first upper face 38 and a substantially planar first lower face 39. Moreover, it comprises diametrically opposing lower cake slice-shaped throughflow holes 40, 41 which extend from the first upper face 38 as far as the first lower face 39.

The first upper face 38 is surrounded by a circular double lip seal 42, the sealing lips 43, 44 thereof extending upwards perpendicular to the first upper face 38. The double lip seal may also be denoted as a "double-lamella seal". Moreover, two diametrically opposing cake slice-shaped sealing cushions 45, 46 are arranged on the first upper face 38, said diametrically opposing cake slice-shaped sealing cushions being arranged on the angle bisector between the two lower cake slice-shaped lower throughflow holes 40, 41.

The cake slice-shaped throughflow holes 40, 41 and the cake slice-shaped sealing cushions 45, 46 widen at an increasing distance from the centre of the circular disc-shaped partition 37.

Moreover, the closure ring on the lower face of the second lower peripheral part portion has a circular disc-shaped sealing element 47.

Moreover, the lower closure ring 30 on the outer periphery of the first lower peripheral part portion 32 has two opposing longitudinal grooves 48, 49 which in each case are connected to an annular groove 50, 51, which at the bottom is defined by the second lower peripheral part portion 34. Adjacent to each longitudinal groove 48, 49 in the respective adjacent annular groove 50, 51 a latching projection 52, 53 is present in each case. The latching projections 52, 53 have in each case a chamfer toward the longitudinal sides 48, 49 and/or the annular grooves 50, 51. The annular grooves 50, 51 are in each case defined on the opposing ends by stops 54, 55, which at the same time separate the annular grooves 50, 51 from the adjacent longitudinal grooves 48, 49.

On the second lower peripheral part portion externally on diametrically opposing peripheral regions, in each case are two semi-circular lower raised portions 56, 57 with the printed text "press open". By pressing against the semi-circular lower raised portion 56, 57, it is possible to displace the latching projections 52, 53, arranged adjacent thereto, slightly inwards.

The lower closure ring 30 is, in principle, produced from a hard elastic plastics material, for example from polypropylene (PP). A soft elastic sealing material is injection-moulded on the lower closure ring 30 which forms the double lip seal 42, the sealing cushions 45, 46 and the sealing element 47. The sealing material is injection-moulded such that it connects all the aforementioned seals 42, 45, 46, 47 together. For example, it is a thermoplastic elastomer (TPE).

According to FIGS. 2 and 4, the upper closure ring 60 has an upper peripheral part 61 with a plurality of portions. The substantially cylindrical first upper peripheral part portion 62 has an external thread 63 on the external periphery. The first upper peripheral part portion 62 is connected on the lower edge to a second upper peripheral part portion 64 protruding radially outwards. The second upper peripheral part portion 64 is connected in turn on the external periphery to a third upper peripheral part portion 65 protruding axially downwards. The third upper peripheral part portion 65 has on the inner periphery two protruding claws 66, 67 which diametrically oppose one another. On the outside, the third upper peripheral part portion 65 has two semi-circular upper raised portions 68, 69 protruding radially outwards, which also diametrically oppose one another. The upper raised portions 68, 69 are offset by 90° relative to the claws 66, 67.

Moreover, the upper closure ring 60 comprises a circular disc-shaped upper partition 70 which, slightly below the upper edge of the first upper peripheral part portion 62, is connected thereto and blocks the cross section of the upper peripheral part 61. The upper partition 70 has a substantially planar second upper face 71 and a substantially planar second lower face 72. Moreover, it has diametrically opposing cake slice-shaped upper through-holes 73, 74, which in each case open into the second upper face 71 and into the second lower face 72. The upper through holes 73, 74 diametrically oppose one another.

On the second lower face 72, the upper partition 70 has a circular seal geometry 75 complementary to the double lip seal. This seal geometry 75 has two circular peripheral sealing grooves 76, 77, into which the sealing lips 43, 44 of the double lip seal 42 are able to engage. The seal geometry 75 is arranged concentrically to the first upper peripheral part 61 and to the circular disc-shaped upper partition 70.

The upper closure ring is, for example, produced from PP.

The upper closure ring 60 is able to be inserted with the claws 66, 67 into the longitudinal grooves 48, 49 of the lower closure ring 30, until the claws 66, 67 strike against the second lower peripheral part portion 34. In this case, the double lip seal 42 engages in the sealing grooves 76, 77 of the seal geometry 75. By rotating the upper closure ring 60 by approximately 15° the claws 66, 67 of the upper closure ring 60 spring over the latching projections 52, 53 of the lower closure ring 30 so that the lower and the upper closure ring 30, 60 are captively connected together. If the claws 66, 67 have sprung over the latching projections 52, 53, the lower and upper through-holes 40, 41 and 73, 74 are in an overlapping position in which liquid is able to pass through the closure system 20. This position is shown in FIG. 1.

By further rotation of the upper closure ring 60 relative to the lower closure ring 30 until the claws 66, 67 strike against the stops 55, 56, the upper throughflow holes 73, 74 are sealed by the sealing cushions 45, 46 of the lower closure ring 30. In this case, the sealing cushions 45, 46 bear sealingly on the edge against chamfers or respectively bevels on the edge of the throughflow holes 73, 74, which form sealing seats. The closure system 20 is then closed and liquid is not able to pass through the through-holes 40, 41, 73, 74. At the moment of closure, the closure system 20 emits an acoustic clicking noise.

The closure system 20 is opened again by the upper closure ring 60 being rotated in the opposing direction until it reaches the position in which the claws strike against the latching projections 55, 56. This stop position can only be overcome when the lower closure ring is deformed by compressing the two semi-circular lower raised portions 56, 57. The lower closure ring 30 may only be deformed when the closure system 20 has been screwed off the bottle 10. The upper raised portions 68, 69 on the upper closure ring 60 simplify the rotation of the upper closure ring 60 relative to the lower closure ring 30. Moreover, with a suitable arrangement of specific positions, they may display, for example, the position in which the claws 66, 67 engage in the longitudinal grooves 48, 49.

According to FIG. 1, the screw ring 90 has a circular cylindrical annular portion 91 with an internal screw ring thread 92 on the inner periphery and an annular flange 93 protruding radially inwards from the upper edge, with a screw ring-annular groove 94 on the lower face. The screw ring 90 is screwed to the external thread 63. The annular flange 93 is pressed against the upper edge of the second closure ring.

The screw ring may comprise on the outer periphery a coating 95 made of a soft elastic plastics material. It is, for example, injection-moulded from PP and the soft elastic material is, for example, injection-moulded TPE.

According to FIG. 1 the drinking teat 100 has a mouthpiece 101 with a slotted valve 102 and a teat 103 with a drinking hole 104 and/or drinking slot at the end and a spout 105 carrying the mouthpiece 101. On the lower edge of the spout 105 it has an outwardly oriented teat flange 106 with an upwardly protruding sealing bead 107. The drinking teat 100 is, for example, produced from rubber and/or latex or silicone rubber.

According to FIG. 1, the drinking teat 100 is clamped on the teat flange 106 between the upper edge of the upper closure ring 60 and screw ring 90. The sealing bead 107 is fixed in the screw ring-annular groove 94 to the lower face of the annular flange 93.

The screw ring 90 in the closed or open state of the closure system 20 may be screwed onto the closure system or respectively screwed off said closure system.

The novel closure system 20 may be moved by means of rotational movement from the closed state into the open state and vice versa. No individual parts have to be removed in order to bring the closure system 20 into the operative state. Also there is no direct contact with the user and with the food when opening and closing the closure system 20. The risk of contamination of the food is thus considerably reduced. Moreover, it is not possible to lose any individual parts. The closure system 20 can be used for bottles 10 and other containers.

This completes the description of the preferred and alternate embodiments of the invention. Those skilled in the art may recognize other equivalents to the specific embodiment described herein which equivalents are intended to be encompassed by the claims attached hereto.

The invention claimed is:

1. A closure sealing system for a leakproof baby feeding bottle comprising:
- a screw ring (90);
- a drinking teat (100);
- a lower closure ring (30) comprising:
  - a substantially cylindrical lower sidewall (31) having an internal thread (33) for fastening onto an external thread (14) of the bottle (10); and,
  - a lower partition wall (37) having at least one lower hole (40, 41);
- an upper closure ring (60) comprising:
  - a substantially cylindrical upper sidewall (61) having an external thread (63) removably receiving the screw ring (90), thereby fastening the drinking teat (100) to an upper edge of the upper sidewall (61); and,
  - an upper partition wall (70) having at least one upper hole;
- locking elements (48, 49, 50, 51, 66, 67) rotatably and releasably locking together the lower closure ring (30) to the upper closure ring (60); and,
- a sealing arrangement comprising:
  - a circular lip seal (42) made of a soft elastic material and concentric to the lower sidewall (31), the lip seal (42) comprising at least one axially oriented sealing lip (43, 44) disposed on said lower partition wall (37);
  - at least one circular seal geometry (75) engaging the lip seal (42) and disposed on said upper partition wall (70), concentric to the upper sidewall (61); and,
  - wherein rotating the upper closure ring relative to the lower closure ring aligns the at least one upper hole with the at least one lower hole to enable dispensing of contents from the bottle.

2. The closure sealing system according to claim 1, wherein the lip seal (42) is a double lip seal.

3. The closure sealing system according to claim 1, the lower closure ring (30) further comprising two diametrically opposing sealing cushions (45, 46) and the at least one lower hole is two diametrically opposing holes (40, 41, 73, 74).

4. The closure sealing system according to claim 1, the upper closure ring (60) further comprising a sealing seat edge surrounding the at least one upper hole, and the at least one upper hole is two diametrically opposing holes (73, 74).

5. The closure sealing system according to claim 1, wherein the locking elements (48, 49, 50, 51, 66, 67) comprise a bayonet structure.

6. The closure sealing system according to claim 1, wherein the lower closure ring (20, 60) is produced using a two-component injection molding method.

7. The closure sealing system according to claim 1, wherein the lip seal (42) is a thermoplastic elastomer.

8. The closure sealing system according to claim 1, wherein the lower closure ring (30) above the internal thread (33) comprises a circular peripheral sealing element (47) made of a soft elastic material for sealing to the upper edge of a bottle (10).

9. The closure sealing system according to claim 8, wherein the soft elastic material of the lip seal and the soft elastic material of the circular peripheral sealing element extend over the lower partition wall and through the at least one lower hole (40, 41).

10. A closure system for sealing a leakproof baby feeding bottle comprising:
- a lower closure ring (30) comprising:
  - a circular base having (37):
    - a first upper face (38) with at least one triangular sealing cushion made of a soft elastic material;

a first lower face (39);

at least one lower hole (40, 41);

a substantially cylindrical lower sidewall (31) extending downwardly from a perimeter of said circular base and said lower sidewall having an internal thread;

an upper closure ring (60) comprising:

a circular top wall (70) having:

a second upper face (38), a second lower face (39), at least one upper hole (73, 74);

a triangular sealing seat surrounding said at least one upper hole;

a substantially cylindrical upper sidewall (61) extending upwardly from a perimeter of said circular top wall and said upper sidewall having an external thread; and, locking elements (48, 49, 50, 51, 66, 67) rotatably and releasably locking the lower closure ring (30) to the upper closure ring (60);

wherein the upper hole (73, 74) is capable of aligning with the lower hole (40, 41) to form a dispensing opening; and, wherein the at least one triangular sealing cushion is capable of sealing the triangular sealing seat to form a closed end.

11. A closure system for a leakproof baby feeding bottle comprising:

a screw ring (90);

a drinking teat (100);

a lower closure ring (30) comprising:

a substantially cylindrical lower sidewall (31) having an internal thread (33) for fastening onto an external thread (14) of the bottle (10); and, a lower partition wall (37) having at least one lower hole (40, 41);

an upper closure ring (60) comprising:

a substantially cylindrical upper sidewall (61) having an external thread (63) removably receiving the screw ring (90), thereby fastening the drinking teat (100) to an upper edge of the upper sidewall (61); and, an upper partition wall (70) having at least one upper hole;

locking elements (48, 49, 50, 51, 66, 67) rotatably and releasably locking together the lower closure ring (30) to the upper closure ring (60);

a sealing arrangement comprising:

a circular lip seal (42) made of a soft elastic material and concentric to the upper sidewall (61), the lip seal (42) comprising at least one axially oriented sealing lip (43, 44) disposed on said upper partition wall (70);

at least one circular seal geometry (75) engaging the lip seal (42) and disposed on said lower partition wall (37), concentric to the lower sidewall (31); and, wherein rotating the upper closure ring relative to the lower closure ring aligns the at least one upper hole with the at least one lower hole to enable dispensing of contents from the bottle.

* * * * *